US006440496B1

(12) United States Patent
Gupta et al.

(10) Patent No.: US 6,440,496 B1
(45) Date of Patent: Aug. 27, 2002

(54) METHOD OF FORMING A DIFFUSION ALUMINIDE COATING

(75) Inventors: Bhupendra K. Gupta, Cincinnati; Thomas E. Mantkowski, Madeira; Nripendra N. Das, West Chester; Raymond W. Heidorn, Fairfield, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/487,103

(22) Filed: Jan. 19, 2000

Related U.S. Application Data

(62) Division of application No. 09/016,975, filed on Feb. 2, 1998, now Pat. No. 6,168,874.

(51) Int. Cl.[7] ..... C23C 16/06
(52) U.S. Cl. ..... 427/252; 427/255.31; 427/255.7
(58) Field of Search ..... 427/253, 255.7, 427/255.31, 252

(56) References Cited

U.S. PATENT DOCUMENTS

| | | | | |
|---|---|---|---|---|
| 4,405,659 A | | 9/1983 | Strangman | |
| 5,238,752 A | | 8/1993 | Duderstadt et al. | |
| 5,558,922 A | | 9/1996 | Gupta et al. | |
| 5,624,721 A | | 4/1997 | Strangman | |
| 5,645,893 A | * | 7/1997 | Rickerby et al. | 427/255.7 |
| 5,681,616 A | | 10/1997 | Gupta et al. | |
| 5,683,825 A | | 11/1997 | Bruce et al. | |
| 5,723,078 A | | 3/1998 | Nagaraj et al. | |
| 5,817,371 A | * | 10/1998 | Gupta et al. | 427/456 |
| 5,817,372 A | * | 10/1998 | Zheng | 427/456 |
| 5,876,860 A | * | 3/1999 | Marijnissen et al. | 427/255.7 |
| 5,900,326 A | | 5/1999 | Bornstein et al. | |
| 5,975,852 A | * | 11/1999 | Nagaraj et al. | 427/419.2 |
| 6,123,997 A | * | 9/2000 | Schaeffer et al. | 427/255.7 |

FOREIGN PATENT DOCUMENTS

| | | |
|---|---|---|
| EP | 0 532 252 A | 3/1993 |
| EP | 0 821 078 A | 1/1998 |
| EP | 0821078 A1 * | 1/1998 |
| EP | 0 845 547 A | 6/1998 |
| JP | 55 113880 A | 9/1980 |

* cited by examiner

*Primary Examiner*—Bret Chen
(74) *Attorney, Agent, or Firm*—V. G. Ramaswamy; Gary M. Hartman; Domenica N. S. Hartman

(57) ABSTRACT

A thermal barrier coating system and a method for forming the coating system on a component designed for use in a hostile thermal environment, such as superalloy turbine, combustor and augmentor components of a gas turbine engine. The coating system includes a diffusion aluminide bond coat whose oxide growth rate is significantly reduced to improve the spallation resistance of a thermal barrier layer by forming the bond coat to include a dispersion of aluminum, chromium, nickel, cobalt and/or platinum group metal oxides. The oxides preferably constitute about 5 to about 20 volume percent of the bond coat. A preferred method of forming the bond coat is to initiate a diffusion aluminizing process in the absence of oxygen to deposit a base layer of diffusion aluminide, and then intermittently introduce an oxygen-containing gas into the diffusion aluminizing process to form within the bond coat the desired dispersion of oxides. Thereafter, a ceramic layer is deposited on the bond coat to form a thermal barrier coating.

20 Claims, 1 Drawing Sheet

METHOD OF FORMING A DIFFUSION ALUMINIDE COATING

This is a division of patent application Serial No. 09/016,975, filed Feb. 2, 1998 now U.S. Pat. No. 6,168,874.

FIELD OF THE INVENTION

The present invention relates to processes for depositing protective coatings. More particularly, this invention relates to a process for forming a diffusion aluminide bond coat of a thermal barrier coating system, such as of the type used to protect gas turbine engine components.

BACKGROUND OF THE INVENTION

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain sections of a gas turbine engine, such as the turbine, combustor and augmentor. A common solution is to provide turbine, combustor and augmentor components with an environmental coating that inhibits oxidation and hot corrosion, or a thermal barrier coating (TBC) system that, in addition to inhibiting oxidation and hot corrosion, also thermally insulates the component surface from its operating environment.

Coating materials that have found wide use as environmental coatings include diffusion aluminide coatings, which are generally single-layer oxidation-resistant layers formed by a diffusion process, such as pack cementation. Diffusion processes generally entail reacting the surface of a component with an aluminum-containing gas composition to form two distinct zones, the outermost of which is an additive layer containing an environmentally-resistant intermetallic represented by MAl, where M is iron, nickel or cobalt, depending on the substrate material. Beneath the additive layer is a diffusion zone comprising various intermetallic and metastable phases that form during the coating reaction as a result of diffusional gradients and changes in elemental solubility in the local region of the substrate. During high temperature exposure in air, the MAl intermetallic forms a protective aluminum oxide (alumina) scale or layer that inhibits oxidation of the diffusion coating and the underlying substrate.

For particularly high temperature applications, a thermal barrier coating (TBC) can be deposited on a diffusion coating, then termed a bond coat, to form a thermal barrier coating system. Various ceramic materials have been employed as the TBC, particularly zirconia ($ZrO_2$) fully or partially stabilized by yttria ($Y_2O_3$), magnesia (MgO), ceria ($CeO_2$), scandia ($Sc_2O_3$), or other oxides. These particular materials are widely employed in the art because they exhibit desirable thermal cycle fatigue properties, and also because they can be readily deposited by plasma spray, flame spray and vapor deposition techniques.

A bond coat is critical to the service life of the thermal barrier coating system in which it is employed, and is therefore also critical to the service life of the component protected by the coating system. The oxide scale formed by a diffusion aluminide bond coat is adherent and continuous, and therefore not only protects the bond coat and its underlying superalloy substrate by serving as an oxidation barrier, but also chemically bonds the ceramic layer. Nonetheless, aluminide bond coats inherently continue to oxidize over time at elevated temperatures, which gradually depletes aluminum from the bond coat and increases the thickness of the oxide scale. Eventually, the scale reaches a critical thickness that leads to spallation of the ceramic layer at the interface between the bond coat and the aluminum oxide scale. Once spallation has occurred, the component will deteriorate rapidly, and therefore must be refurbished or scrapped at considerable cost.

Improved TBC life has been achieved with the addition of platinum group metals in diffusion aluminide bond coats. Typically, platinum or palladium is introduced by plating the substrate prior to the diffusion aluminizing process, such that upon aluminizing the additive layer includes PtAl intermetallic phases, usually $PtAl_2$ or platinum in solution in the MAl phase. The presence of a platinum group metal is believed to inhibit the diffusion of refractory metals into the oxide scale surface, where they would otherwise form phases containing little aluminum and therefore would oxidize rapidly. It would be desirable if the oxide scale growth rate of an aluminide bond coat could be further reduced to yield a thermal barrier coating system, and therefore the component protected by the coating system, that exhibits improved service life.

SUMMARY OF THE INVENTION

The present invention generally provides a thermal barrier coating system and a method for forming the coating system on a component designed for use in a hostile thermal environment, such as superalloy turbine, combustor and augmentor components of a gas turbine engine. The method is particularly directed to a thermal barrier coating system that includes an oxidation-resistant diffusion aluminide bond coat on which an aluminum oxide scale is grown to protect the underlying surface of the component and adhere an overlying thermal-insulating ceramic layer.

According to this invention, the oxide growth rate on the diffusion aluminide bond coat can be significantly reduced to improve spallation resistance for the ceramic layer by forming the bond coat to include a dispersion of aluminum, chromium, nickel, cobalt and/or platinum group metal oxides. The oxides preferably constitute about five to about twenty volume percent of the bond coat, with a preferred level being about seven to about fifteen volume percent oxides. While applicable to any diffusion aluminide bond coat, a preferred bond coat is a platinum aluminide. The bond coat may optionally overlie or underlie a layer formed of one or more of the same oxides as for the oxide dispersion, e.g., aluminum, chromium, nickel, cobalt and platinum group metal oxides.

According to the invention, a preferred method for forming the bond coat is to initiate a diffusion aluminizing process in the absence of oxygen to deposit a base layer of diffusion aluminide, and then intermittently introduce an oxygen-containing gas into the diffusion aluminizing process to form within the bond coat the desired dispersion of oxides. Thereafter, a ceramic layer is deposited on the bond coat to form a thermal barrier coating.

According to this invention, the process described above yields finely distributed primary and complex (i.e., compound) oxides of aluminum, nickel, chromium and, if present, platinum group metals, yielding a bond coat that exhibits enhanced cyclic oxidation resistance and a reduced oxide growth rate. The result is a thermal barrier coating system that can exhibit an improved thermal cycle fatigue life of three-times lordlier than an otherwise identical coating system without the fine oxide dispersion in the bond coat.

Other objects and advantages of this invention will be better appreciated from the following detailed description.

DETAILED DESCRIPTION OF THE INVENTION

Figure 1:
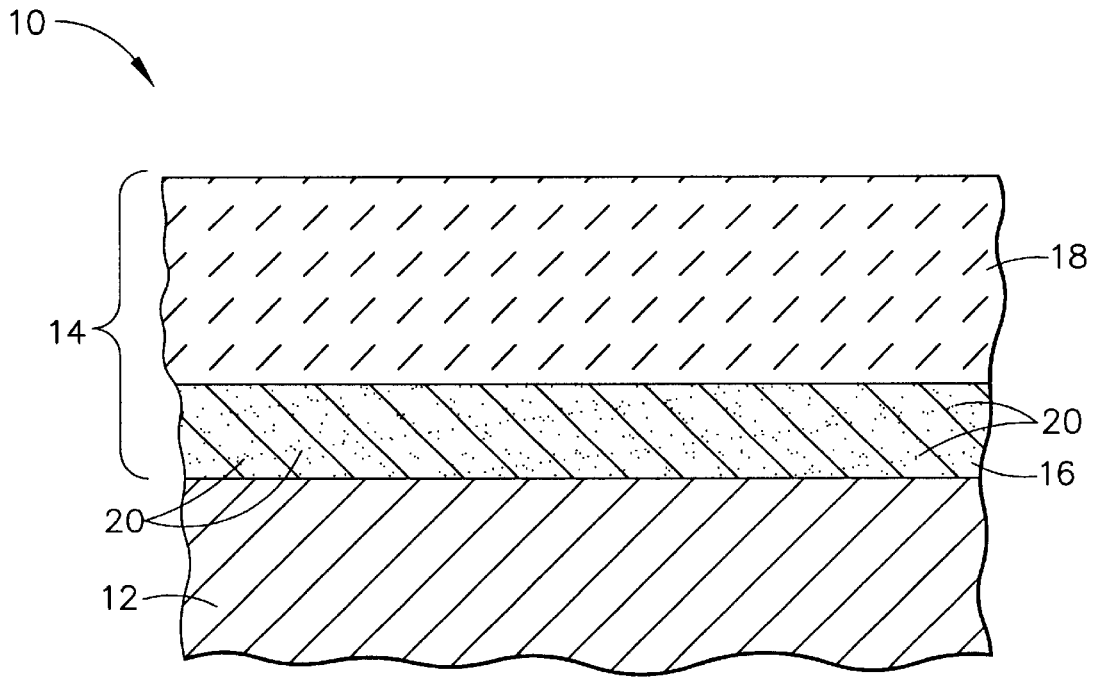
FIG. 1 is a cross-sectional view of a gas turbine engine blade and shows a thermal barrier coating system on the blade incorporating a diffusion aluminide bond coat in accordance with this invention.

The present invention is generally applicable to components that operate within environments characterized by relatively high temperatures, and are therefore subjected to a hostile oxidizing environment and severe thermal stresses and thermal cycling. Notable examples of such components include the high and low pressure turbine nozzles and blades, shrouds, combustor liners and augmentor hardware of gas turbine engines. While the advantages of this invention will be described with reference to gas turbine engine hardware, the teachings of the invention are generally applicable to any component on which a thermal barrier coating system may be used to protect the component from its environment.

Represented in FIG. 1 is a thermal barrier coating system 14 in accordance with this invention. The coating system 14 is shown as including a ceramic layer 18 and a diffusion platinum aluminide bond coat 16 overlying a substrate 12, which is typically the base material of the component protected by the coating system 14. Suitable materials for the substrate 12 (and therefore the component) include nickel, iron and cobalt-base superalloys. The platinum aluminide bond coat 16 is generally characterized by an additive layer that overlies a diffusion zone, the former of which contains an oxidation-resistant MAl intermetallic phase, such as the nickel-aluminide beta phase (NiAl). The additive layer also contains PtAl intermetallic phases, usually $PtAl_2$ or platinum in solution in the MAl phase, as a result of platinum having been plated or otherwise deposited on the substrate 12 prior to aluminizing. Coatings of this type form an aluminum oxide scale (not shown) on their surface during exposure to engine environments. The oxide scale inhibits oxidation of the bond coat 16 and substrate 12, and chemically bonds the ceramic layer 18 to the bond coat 16. A suitable thickness for the bond coat 16 is about 25 to about 150 micrometers.

The ceramic layer 18 overlying the aluminide bond coat 16 is required for high temperature components of gas turbine engines. As noted above, the ceramic layer 18 is chemically bonded to the oxide scale on the surface of the bond coat 16. A preferred ceramic layer 18 has a strain-tolerant columnar grain structure achieved by physical vapor deposition (PVD) techniques known in the art, e.g., electron beam physical vapor deposition (EBPVD), though ceramic layers are also formed by air plasma spray (APS) techniques. A suitable material for the ceramic layer 18 is zirconia that is partially or fully stabilized with yttria (YSZ), though other ceramic materials could be used, including yttria or zirconia stabilized by magnesia, ceria, scandia or other oxides. The ceramic layer 18 is deposited to a thickness that is sufficient to provide the required thermal protection for the underlying substrate 12, generally on the order of about 75 to about 300 micrometers.

According to this invention, the bond coat 16 includes a dispersion of oxides 20 that promote the spallation resistance of the ceramic layer 18 by slowing the oxide growth rate of the bond coat 16. As a result of the process by which the oxides 20 are formed, which will be described below, the oxides 20 are primary and complex oxides of those metals present at the surface of the substrate 12, such as aluminum, chromium, nickel and platinum. Accordingly, the dispersion of oxides 20 is likely to include alumina ($Al_2O_3$), chromia ($Cr_2O_3$), nickel oxide (NiO) and platinum dioxide ($PtO_2$), and compound oxides such as NiO—$Cr_2O_3$, $Al_2O_3$—NiO, etc. It is within the scope of the invention to use another metal of the platinum metal group instead of platinum, which would result in the presence of oxides of that metal instead of platinum. Also as a result of the process by which the oxides 20 are formed, the oxides are finely distributed in the bond coat 16, effectively yielding a composite bond coat 16.

According to this invention, the presence of a fine dispersion of oxides 20 in a diffusion aluminide bond coat 16 has been found to slow the oxide scale growth rate and promote the adhesion of the oxide scale on the bond coat 16, all of which promotes the spallation resistance of the ceramic layer 18. Thermal barrier coating systems according to this invention can exhibit a thermal cycle resistance of at least about three times greater than prior art TBC systems with a conventional platinum aluminide bond coat. To achieve the advantages of this invention, the oxides 20 are preferably present in the bond coat 16 in amounts of about five to about twenty volume percent, more preferably about seven to about fifteen volume percent. In addition, the oxides 20 preferably have a fine particle size, on the order of about twenty micrometers and less, typically about five to ten micrometers.

The method by which the bond coat 16 and oxides 20 are formed is a vapor phase aluminizing process, such as vapor phase deposition, chemical vapor deposition (CVD) and out-of-pack deposition. Such processes are well known in the art, and are conventionally carried out in an inert atmosphere within a coating chamber. However, with this invention, an oxygen source such as air or water vapor is introduced into the chamber at appropriate intervals to produce and codeposit the oxides 20 with the bond coat 16. For example, a modified vapor phase process in accordance with this invention entails placing a platinum-plated component in a chamber that is evacuated or filled with a nonoxidizing or inert gas, such as argon. The chamber and its contents are then heated to at least 1800°F. (about 982° C.), preferably about 1900–1925°F. (about 1038–1052° C.), and an aluminum halide gas, such as aluminum chloride, is flowed into the chamber as a source of aluminum. The aluminum halide reacts at the substrate surface to form an MAl intermetallic, where M is iron, nickel or cobalt, depending on the substrate material, and PtAl intermetallics as a result of the presence of platinum on the substrate surface. Aluminizing is initiated while the chamber is evacuated or filled with the nonoxidizing or inert gas, such that an oxide-free aluminide coating initially forms on the component surface. This step is preferably performed for about one to two hours, though longer and shorter durations could be used.

A source of oxygen, such as air, air saturated with water or water vapor, is then introduced into the chamber, such as through an exhaust line of a conventional aluminizing chamber. Generally, an increase of the oxygen content within the coating chamber of about 0.5 to 1.0 volume percent is desirable. For this purpose, the oxygen source is preferably flowed into the chamber for about ten to thirty seconds, though shorter and longer durations (e.g., up to about one hour) again are foreseeable, depending on gas flow rate, the size of the coating chamber, and the number of articles being coated. The presence of the oxygen source causes the coating gases to oxidize, resulting in the formation and deposition of fine oxides along with aluminum, resulting in an aluminide coating containing a fine dispersion of the oxides. Preferably, flow of the oxygen source is then terminated after which conventional aluminizing resumes, such as for a period of three to four hours, in order to obtain a desired coating thickness, generally on the order of about 50 to about 75 micrometers. Finally, the component and its aluminide coating are then preferably heat treated in a vacuum at a temperature of about 1900°F. to about 1950° F. (about 1038° C. to about 1066° C.) for about two to about six hours to homogenize and ductilize the bond coat and its oxide dispersion.

During investigations leading to this invention, nickel-base superalloy specimens were coated with thermal barrier coating systems whose bond coats were either prior art diffusion platinum aluminides or formed in accordance with this invention. Specifically, specimens were formed of the nickel-base superalloy René N5 having a nominal composition, by weight, of about 7.5 cobalt, 7.0 chromium, 1.5 molybdenum, 5.0 tungsten, 3.0 rhenium, 6.5 tantalum, 6.2 aluminum, 0.15 hafnium, 0.05 carbon, 0.004 boron, with the balance nickel and incidental impurities. Bond coats formed in accordance with this invention were diffusion platinum aluminides containing about 5 to 20 volume percent of a fine dispersion of primary and complex oxides, primarily aluminum, nickel, chromium and platinum oxides. In contrast, the prior art bond coats evaluated were conventional diffusion platinum aluminides. All bond coats were approximately 70 micrometers in thickness. A TBC of yttria-stabilized zirconia (YSZ) having a thickness of about five mils (about 125 micrometers) was then deposited on each of the bond coats by physical vapor deposition.

Results of furnace cycle testing at about 2075° F. (about 1135° C.) resulted in the bond coats of this invention achieving a minimum thermal cycle life of about 1400 hours before spallation of the TBC, while the specimens with the conventional bond coats exhibited an average life of only about 550 hours. Accordingly, the bond coat of this invention resulted in a thermal cycle life of at least about 2.5 times better than that achieved with the prior art bond coat. These results evidenced the remarkably improved spallation resistance of thermal barrier coating systems of this invention as compared to Drior art coating systems. The increased time to spallation for the specimens prepared in accordance with this invention was attributed to a combination of decreased oxide growth rate and improved oxidation resistance afforded by the fine dispersion of oxides.

While the invention has been described in terms of a preferred embodiment, it is apparent that other forms could be adopted by one skilled in the art. For example, the sequence of the deposition process could be other than that described in the example. One possibility is to form an oxide monolayer below and/or on top of the aluminide bond coat by introducing an oxygen source into the coating chamber at the beginning and/or end of the aluminizing process. Another possible alternative is to vary the durations of the aluminizing steps to alter the amount of oxide present in the bond coat. Accordingly, the scope of the invention is to be limited only by the following claims.

What is claimed is:

1. A method for forming a diffusion aluminide coating on a surface of a component, the method comprising the step of codepositing aluminum and oxides on the surface of the component so that the oxides are dispersed within at least an interior portion of the diffusion aluminide coating.

2. A method as recited in claim 1, wherein the diffusion aluminide coating contains about 5 to about 20 volume percent oxides.

3. A method as recited in claim 1, wherein the diffusion aluminide coating contains platinum aluminide intermetallic.

4. A method as recited in claim 1, wherein the oxides are selected from the group consisting of oxides of aluminum, chromium, nickel, cobalt and platinum group metals.

5. A method as recited in claim 1, further comprising the step of growing an alumina scale on the diffusion aluminide coating.

6. A method as recited in claim 1, further comprising the step of depositing a ceramic layer on the diffusion aluminide coating.

7. A method as recited in claim 1, further comprising the step of depositing a substantially oxide-free aluminide layer prior to the step of codepositing the aluminum and the oxides.

8. A method as recited in claim 1, further comprising the step of depositing aluminum without oxides after the step of codepositing the aluminum and the oxides.

9. A method as recited in claim 1, wherein the diffusion aluminide coating is formed by a vapor phase process.

10. A method as recited in claim 1, wherein the codepositing step is a diffusion aluminizing process in which an oxygen source is introduced into the process to form the oxides as the aluminum is being deposited.

11. A method as recited in claim 10, wherein the codepositing step is performed in an enclosure, and wherein the oxygen source is intermittently introduced into the enclosure.

12. A method as recited in claim 11, further comprising the steps of initially aluminizing the surface of the component in the absence of the oxygen source prior to the codepositing step, and performing an aluminizing step in the absence of the oxygen source after the codepositing step.

13. A method as recited in claim 1, further comprising the step of heat treating the component so as to homogenize and ductilize the diffusion aluminide coating.

14. A method for forming a thermal barrier coating system on a surface of a component, the method comprising the steps of:

forming a diffusion aluminide bond coat on the surface of the component by initiating a vapor phase aluminizing process in the absence of an oxygen-containing gas, and intermittently introducing an oxygen-containing gas into the vapor phase aluminizing process to form within the bond coat a dispersion of oxides selected from the group consisting of aluminum, chromium, nickel, cobalt and platinum group metals;

forming a ceramic layer on the bond coat; and heat treating the component to homogenize and ductilize the bond coat.

15. A method as recited in claim 14, wherein the bond coat contains about 5 to about 20 volume percent oxides.

16. A method as recited in claim 14, wherein the bond coat contains platinum aluminide intermetallic.

17. A method as recited in claim 14, wherein the oxides have a particle size of about twenty micrometers or less.

18. A method as recited in claim 14, wherein the ceramic layer is deposited on an alumina scale grown on the surface of the bond coat.

19. A method as recited in claim 14, wherein the introduction of the oxygen-containing gas is terminated prior to the conclusion of the bond coat forming step.

20. A method as recited in claim 19, wherein the vapor phase aluminizing process is continued for about three to about four hours after terminating the introduction of the oxygen-containing gas.

* * * * *